United States Patent [19]

Sorenson

[11] Patent Number: 4,803,788

[45] Date of Patent: Feb. 14, 1989

[54] CLAMPING ATTACHMENT FOR BACKHOE

[75] Inventor: Randall D. Sorenson, Sandy, Utah

[73] Assignee: SoCo Manufacturing, Sandy, Utah

[21] Appl. No.: 145,820

[22] Filed: Jan. 19, 1988

[51] Int. Cl.[4] ..... E02F 3/76

[52] U.S. Cl. ..... 37/117.5; 37/DIG. 3; 37/DIG. 12; 414/704

[58] Field of Search ..... 37/117.5, DIG. 3, DIG. 12, 37/118 R; 414/722, 724, 739, 741, 704

[56] References Cited

U.S. PATENT DOCUMENTS 4,515,522 5/1985 Sonerud ..... 37/117.5 X
4,517,755 5/1985 Nicholson ..... 37/117.5
4,519,739 5/1985 Risch ..... 37/DIG. 12

FOREIGN PATENT DOCUMENTS 6502573 2/1966 Netherlands ..... 37/117.5

*Primary Examiner*—Edgar S. Burr
*Assistant Examiner*—Moshe I. Cohen
*Attorney, Agent, or Firm*—J. Winslow Young

[57] ABSTRACT

This invention involves replacing the link plates in the hydraulically actuate linkage mechanism of a backhoe apparatus with a pivotal cantilever. The cantilever mechanism forms a movable lever arm against which objects can be clamped by the bucket. The length and curvature of the lever arm is selectively predetermined to minimize interference with normal operation of the bucket while providing a support against which objects can be clamped by the bucket.

9 Claims, 5 Drawing Sheets

( PRIOR ART )

CLAMPING ATTACHMENT FOR BACKHOE

BACKGROUND

1. Field of the Invention

This invention relates to backhoe equipment and, more particularly, to a clamping attachment in the form of a pivotal cantilever for placement on the dipper boom of a backhoe adjacent the backhoe bucket as a replacement for the link plate interconnected to the hydraulic actuator system, the cantilever forming a movable lever arm against which the backhoe bucket can be pivoted so as to clamp an object between the bucket and the clamping device.

2. The Prior Art

The backhoe is a commonly available machine used primarily for digging in the earth. The backhoe derives its name from its method of operation; namely, the action of drawing the digging bucket in a "hoe" action "back" toward the operator. The bucket is pivotally mounted on the end of an articulated boom. Hydraulic actuators supply the necessary forces to position and move the articulated boom and its attached bucket in the desired manner. An operator manipulates various hydraulic controls in order to cause a corresponding hydraulic manipulation of the bucket. A skilled operator finds the backhoe to be a very versatile piece of equipment not only for digging in the earth but also for trenching; breaking walls, concrete, etc.; scooping; and clearing operations.

Numerous attachments have been developed for the backhoe. Examples include chipper attachments; pneumatic hammer attachments, and hydraulically actuated jaws, to name a few. Each of these devices are intended to extend the range of possible applications for the conventional backhoe. However, in most instances the modification of the particular backhoe or rather backhoe bucket for one of these specialty applications renders that particular bucket inoperative as a general purpose digging tool. Continued changeover from one configuration to the other is laborious, time-consuming, and requires that the attachment equipment be readily available at the operating site.

Many operators forego these various pieces of adaptive equipment and simply attempt to use the backhoe for certain tasks for which it is ill-suited. For example, frequently the backhoe is used for lifting a large slab of concrete, a beam, tree trunk, or such other object that is too large to be received in the bucket. This lifting operation is tricky and involves the operator in attempting to clamp the particular, oversize object between the bucket and its supporting boom commonly referred to as the dipper boom. However, since the bucket pivots on the end of the dipper boom, the rearwardly pivoted bucket forms an acute angle with the boom with an ever-decreasing angle. The result is that a fairly thick slab of concrete will tend to slip out of the clamping action as the bucket is pivoted toward the boom. Clearly, the danger associated with slippage of a large slab of concrete is an unacceptable risk necessitating other lifting equipment, costly attachments, or elaborate techniques for handling these types of objects.

In view of the foregoing it would be an advancement in the art to provide a clamping device that cooperates with the existing hydraulic actuator system of a backhoe against which an object can be clamped by a backhoe bucket. It would also be an advancement in the art to provide a clamping device for a backhoe bucket that can be permanently mounted to the backhoe and yet has minimal interference with the conventional operation of the backhoe. It would also be an advancement in the art to provide a clamping apparatus for a backhoe wherein the clamping apparatus can be installed either as new equipment or as a retrofit on existing equipment in the field. Such a novel invention is disclosed and claimed herein.

BRIEF SUMMARY AND OBJECTS OF THE INVENTION

This invention involves a cantilever which is adapted to replace the link plate portion of the linkage between the hydraulic actuator pivot and the dipper boom pivot on a conventional backhoe. The cantilever extends beyond the link plate to form a lever arm which creates a jaw against which large items such as timbers or sections of concrete slab can be clamped by the bucket. The length and curvature, if any, of the lever arm portion of the cantilever are determined by the specific dimensions of the particular backhoe configuration.

It is, therefore, a primary object of this invention to provide improvements in clamping apparatus for backhoe equipment.

Another object of this invention is to provide improvements in the method of clamping an object with the bucket of a backhoe.

Another object of this invention is to provide a lever mechanism that can be affixed to a backhoe to provide a jaw against which an object can be clamped by the backhoe bucket.

Another object of this invention is to provide a clamping system for a backhoe wherein the apparatus of the clamping system substantially avoids interference with the normal operation of the backhoe bucket.

These and other objects and features of the present invention will become more fully apparent from the following description of the invention in combination with the drawings and the appended claims.

DETAILED DESCRIPTION

The invention is best understood by reference to the following description in conjunction with the drawings wherein like parts are designated by like numerals throughout.

Figure 1:
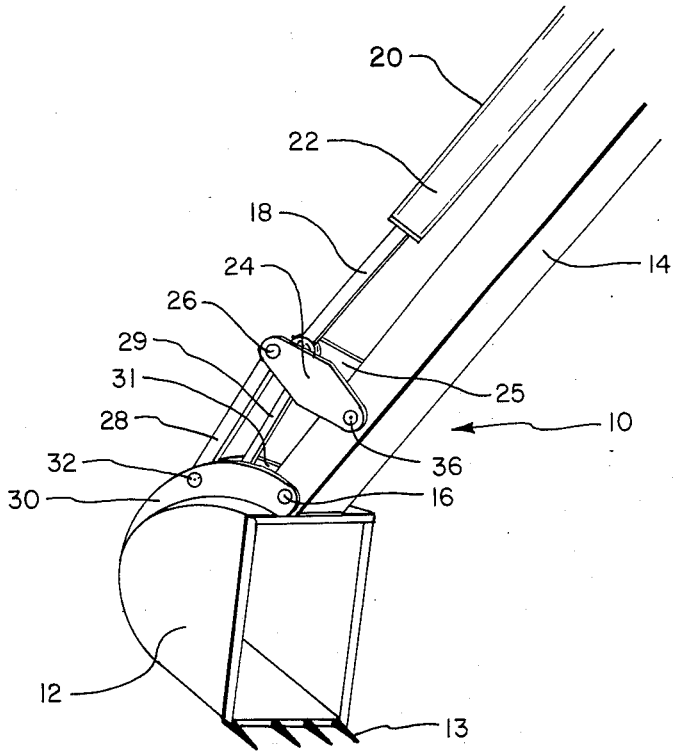
FIG. 1 is a perspective view of a conventional backhoe bucket of the prior art, the bucket being mounted on the end of a dipper boom.

Referring now more particularly to FIG. 1, a conventional backhoe bucket and dipper boom assembly is shown generally at 10 and includes a backhoe bucket 12 pivotally mounted on the end of a dipper boom 14 at a pivot 16. The lower edge of the opening to bucket 12 includes a set of teeth 13. A hydraulic actuator 20 is mounted on the back of dipper boom 14 and includes a cylinder 22 and a piston rod 18. Piston rod 18 moves telescopically in and out of cylinder 22 in response to corresponding control movements of the hydraulic control (now shown) by the operator (not shown). Extension and retraction of piston rod 18 moves bucket 12 arcuately about pivot 16 so as to accomplish the desired movement of bucket 12 as will be discussed more fully hereinafter.

The end of piston rod 18 is pivotally engaged to the ends of link plates 24 and 25. Link plates 24 and 25 are rigidly interconnected by a rod 26 to which piston rod 18 is pivotally engaged adjacent the midpoint of rod 26. Struts 28 and 29 are pivotally mounted to rod 26 on each side of piston rod 18, respectively, and are also pivotally mounted to flanges 30 and 31 on the back of bucket 12. Only one pivot point, pivot point 32 for strut 28 on flange 30 is shown herein, the corresponding pivot point between strut 29 and flange 31 being hidden in this particular view.

Figure 3:
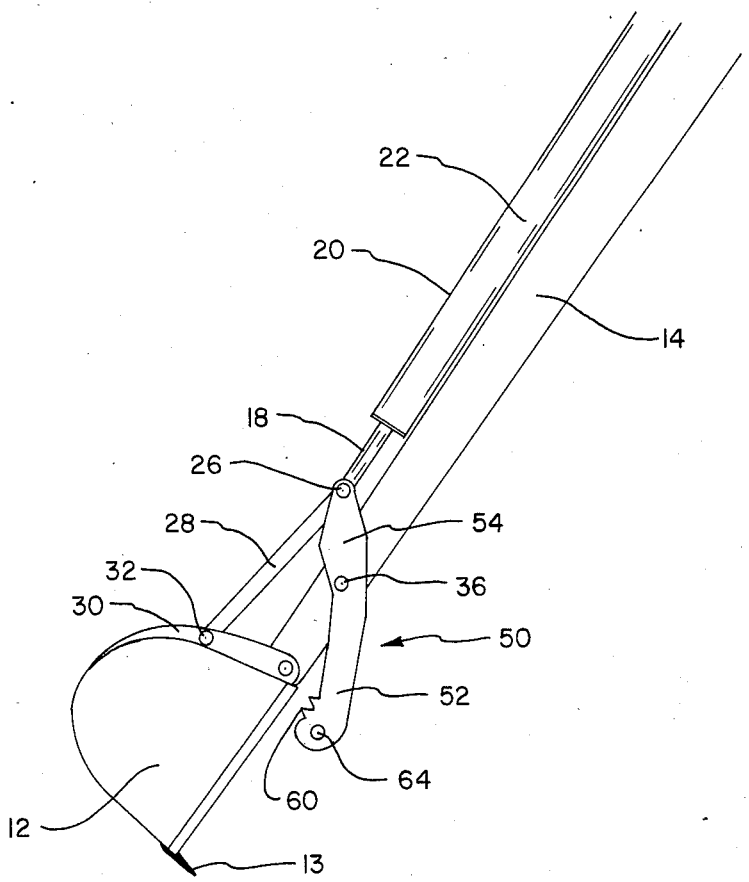
FIG. 3 is a side elevation of the backhoe bucket and clamping apparatus with the bucket being shown in the fully extended position.
Figure 4:
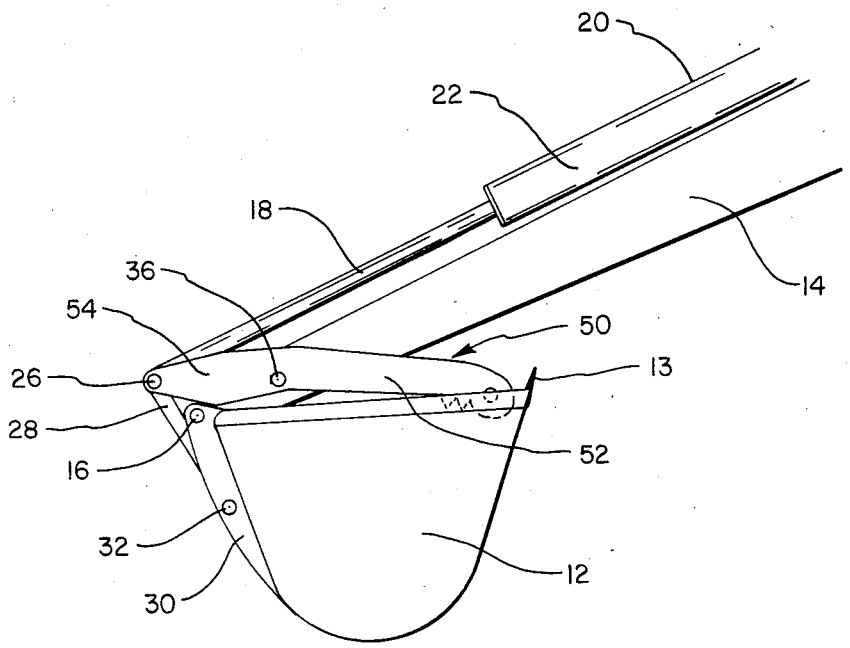
FIG. 4 is a side elevation of the backhoe bucket and clamping apparatus with the bucket being shown in the fully retracted position.

Link plates 24 and 25 are pivotally mounted on opposite sides of dipper boom 14, pivot 36 being shown between link plate 24 and dipper boom 14. The corresponding pivot between link plate 25 and dipper boom 14 is hidden in this particular view of backhoe assembly 10. Movement of piston rod 18 rotates link plates 24 and 25 arcuately about the pivot point shown by pivot 36. Extension of piston rod 18 moves the corresponding end of link plates 24 and 25 in a counter clockwise motion about pivot 36. Correspondingly, retraction of piston rod 18 moves the end of linkage 24 in a clockwise motion about pivot 36. Arcuate movement along this circular path by the ends of struts 28 and 29 is translated into a corresponding arcuate movement of bucket 12 about pivot 16. Advantageously and importantly, the linkage represented by link plates 24 and 25 along with struts 28 and 29 in conjunction with the relative distances between pivots 16, 26, 32, and 36 translates the relatively restricted extension and retraction movement of piston rod 18 into the arcuate movement of bucket 12 about pivot 16. Accordingly, bucket 12 can be moved rearwardly into a position almost parallel with dipper boom 14 as shown in FIG. 3 or brought forwardly into close proximity to dipper boom 14 as shown in FIG. 4. The absence of this linkage would preclude arcuate movement of bucket 12 beyond a point at which piston rod 18 otherwise would strike dipper boom 14. Specific attention is directed to the operating characteristics of this linkage since the novel clamping apparatus 50 of this invention is designed to replace link plates 24 and 25 with a cantilever 50 as will be described more fully hereinafter.

It is important to understand this movement of this linkage in order to recognize the unique feature of this invention; namely that the clamping action of this invention is accomplished in a direction reverse to the action of all other prior art devices. Conventional, hydraulically-actuated clamping equipment (not shown) entails the use of a separate hydraulic piston designed to move a jaw toward the bucket to create the clamping action. Numerous devices are available in various configurations with each configuration including jaws, fingers, claws, or the like, which are provided with a relative motion toward the other component, that is, one jaw, etc., moving toward the other with the third object clamped therebetween.

Figure 5:
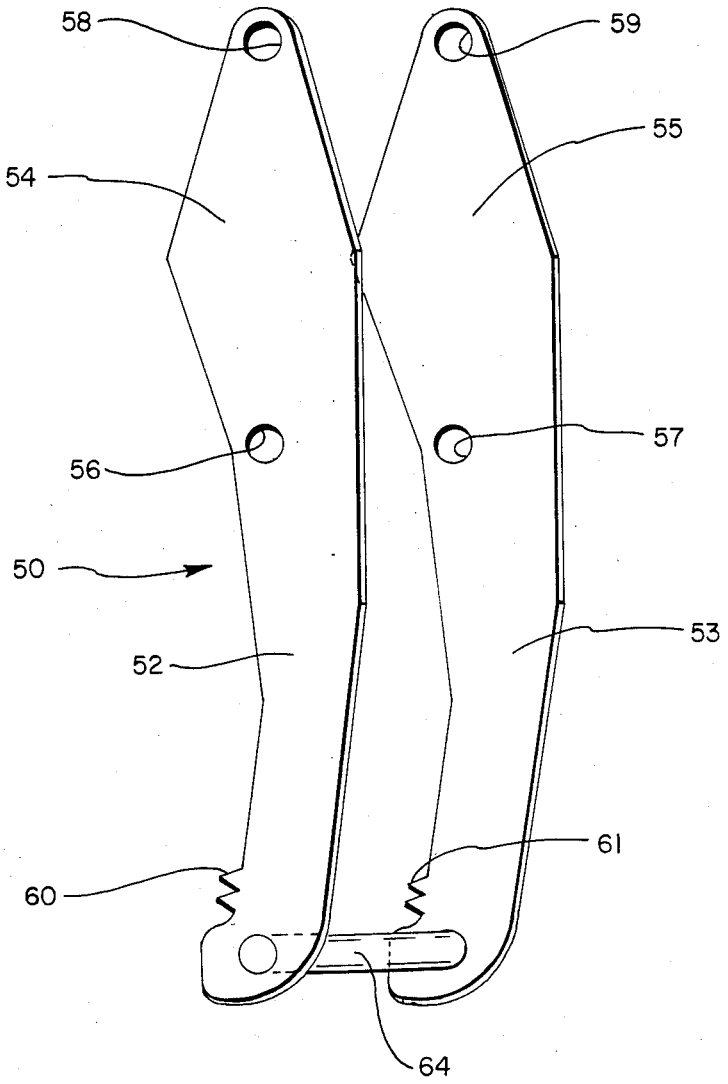
FIG. 5 is an enlarged perspective view of the clamping apparatus of this invention.

Referring now to FIG. 5, the clamping apparatus of this invention is shown as a cantilever 50 and includes a pair of spaced link plates 54 and 55 with lever arms 52 and 53, respectively, formed as extensions thereof. A stiffener 64 is mounted between the ends of lever arms 52 and 53. Pivot mounts 56 and 58 have the identical spatial relationship as pivots 26 and 36 so that link plate 54 is identical in configuration to link plate 24 so as to allow cantilever 50 to replace link plates 24 and 25 by being pivotally mounted to dipper boom 14 with pivot mount 56 on pivot 36. Pivot mount 58 pivotally receives rod 26, rod 26 having piston rod 18 and struts 28 and 29 pivotally mounted thereto. Correspondingly, link plate 25 and lever arm 55 replace link plate 25 to complete the modification from link plates 24 and 25 to the clamping apparatus of cantilever 50.

Stiffener 64 provides the desired degree of dimensional integrity to cantilever 50 and can be either welded in place prior to installation of cantilever 50 or after installation, depending upon the particular requirements of the specific installation. For example, certain backhoe equipment includes a removable pin at pivot 36 so that clamping apparatus 50 can be slipped over dipper boom 14 and the pin of pivot 36 simply inserted and secured in pivot mounts 56 and 57. On the other hand, certain other backhoe equipment includes pivot 36 as a raised boss over which link plate 24 is pivotally mounted. This means that each side of cantilever 50, or more particularly, link plates 54 and 55 must be separately mounted to each side of dipper boom 14 prior to securement of stiffener 64.

Figure 2:
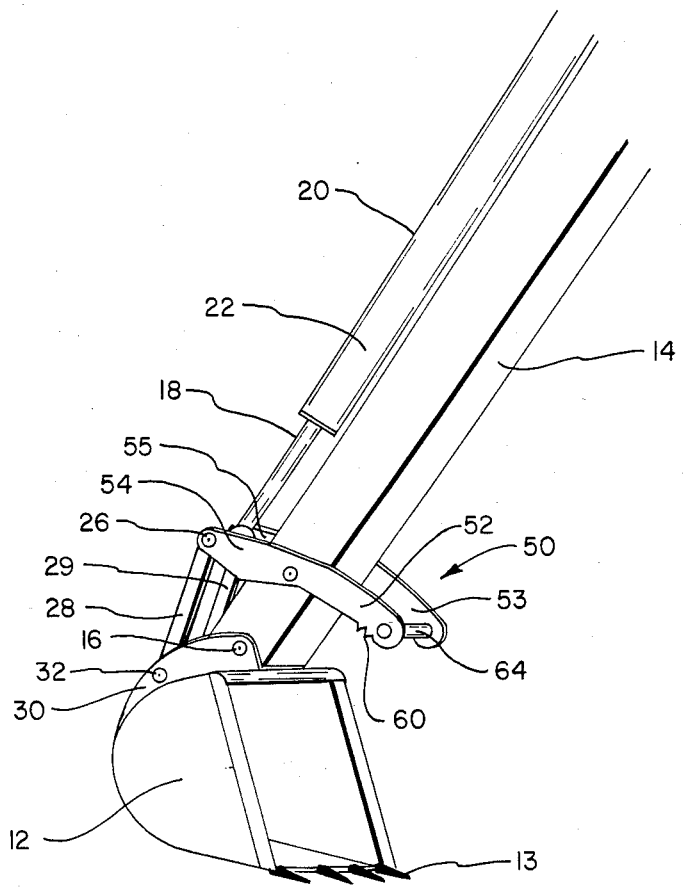
FIG. 2 is a perspective view of the backhoe bucket of FIG. 1 modified with the clamping apparatus of this invention.

Referring now more particularly to FIGS. 2–4 it should be specifically pointed out that with the exception of link plates 24 and 25 (FIG. 1) being replaced by the clamping apparatus of cantilever 50 (FIG. 5) all the other elements of FIGS. 2–4 are identical with those shown and described in FIG. 1. Accordingly, the discussion of the apparatus shown in FIGS. 2–4 will be directed primarily to the unique features of this invention.

Referring specifically to FIG. 3, as discussed hereinbefore with respect to the movement of the linkage including link plates 24 and 25 (FIG. 1), retraction of piston rod 18 pulls the bottom of bucket 12 upwardly to expose downwardly the open face of bucket 12 and teeth 13 for certain digging operations upon the downward movement of dipper boom 14 by the operator (not shown). Note also that the jaw end 60 of the clamping apparatus of cantilever 50 is pivoted in a clockwise direction into a position generally adjacent pivot 16. The length of lever arms 52 and 53 of cantilever 50 are selectively predetermined so as to hold them substantially out of the way from the opening to bucket 12 during digging operations.

Partial extension of piston rod 18 as shown best in FIG. 2 moves lever arms 52 and 53 in a counter clockwise direction away from bucket 12. This action would appear to be contradictory to the desired feature of clamping an object (not shown) between bucket 12 and jaws 60 and 61 (FIG. 5) of clamping apparatus 50. In particular, movement of clamping apparatus of cantilever 50 is away from bucket 12. Conventional thought would appear to dictate that in order to obtain a clamping action between bucket 12 and the clamping apparatus of cantilever 50 it would be necessary to move these elements toward each other so as to join at a predetermined location.

However, and with reference also to FIG. 4, it should be noted that even though cantilever 50 has been moved in a counterclockwise direction away from bucket 12, bucket 12 is now in juxtaposition with cantilever 50 showing that even relatively thin slabs or objects (not shown) can be securely clamped therebetween. This surprising result is obtained because of the relative positioning of pivots 16, 32, 26, and 36, as is well established in the art of mechanical devices.

In summary, although movement of bucket 12 pivotally toward dipper boom 14 causes a corresponding movement of cantilever 50 also toward dipper boom 14 but away from bucket 12, the relative rates of travel of bucket 12 and cantilever 50 ar sufficiently different so that bucket 12 ultimately "catches up" to the clamping apparatus of cantilever 50 to cause the relative clamping action between the two. This unexpected result is unique with this invention and provides numerous benefits to equipment to which it is installed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A clamping apparatus for a hydraulically actuated digging apparatus, the digging apparatus including a dipper boom, a bucket pivotally mounted to the end of the dipper boom, a hydraulic actuator, and linkage for interconnecting the bucket to the hydraulic actuator to accommodate the hydraulic actuator moving the bucket pivotally about the end of the dipper boom, the linkage including a pair of link plates pivotally mounted at a first end to each side of the dipper boom with the hydraulic actuator pivotally mounted to a second end of the link plates, with struts pivotally mounted between the second end of the link plates and the bucket, the improvement comprising a cantilever means comprising lever arms as an extension of said link plates beyond said first end, the length of said lever arms being predetermined so as to cooperate with said bucket to create a clamping action between said bucket and said lever arms when said bucket is pivoted toward said lever arms the linkage pivoting lever arms toward the dipper boom when the bucket is pivoted toward the lever arms but at a slower angular rate so that the bucket engages the lever arms in a clamping action, the length of said lever arms being predetermined so that said lever arms are essentially retracted from said bucket when said bucket is pivoted away from said lever arms.

2. The clamping apparatus defined in claim I wherein said lever arms comprise a truss means for rigidly securing the ends of said lever arms.

3. The clamping apparatus defined in claim 2 wherein the edges of said lever arms adjacent said truss and facing said bucket comprise teeth means to assist in engaging objects clamped between said lever arms and said bucket.

4. The clamping apparatus defined in claim 1 wherein said bucket is incrementally wider than said dipper boom to accommodate receipt of a portion of said lever arms into the opening of said bucket without contacting said bucket.

5. The clamping apparatus defined in claim 1 wherein the lever arms are configured to form an acute angle with said bucket as measured from the ends as said lever arms.

6. A clamping apparatus for a backhoe comprising a boom, a bucket and a pair of lever arms pivoted to said boom, said lever arms having a length predetermined to cooperate with said bucket of said backhoe, each of said lever arms having a link plate formed at a first end on one side of said form a second end on the other side of said boom cooperating with said bucket, said link plate being specifically configurated to form a cantilever mechanism with said second end of said lever arms pivoting away from said bucket at a slower angular rate than said bucket when said bucket is pivoted toward said lever arms resulting in said lever arms cooperating with said bucket to create a clamping action between said bucket and said lever arms.

7. The clamping apparatus defined in claim 6 wherein said lever arms comprise a curvilinear orientation of said lever arms relative to said link plates, said curvilinear orientation being predetermined to form an acute angle to said bucket when said bucket is pivoted against said lever arms.

8. The clamping apparatus defined in claim 7 wherein said lever arms comprise a jaw with teeth formed therein, said teeth cooperating with said bucket during said clamping action to assist in holding an object clamped between said bucket and said jaw.

9. A method for clamping an object with the bucket of a backhoe apparatus wherein the backhoe apparatus includes a dipper boom, the bucket being pivotally mounted to said dipper boom, a hydraulic actuator and a linkage interconnecting said bucket to said hydraulic actuator, a portion of said linkage comprising a pair of link plates pivotally mounted at a first end on opposite sides of said dipper boom and pivotally connected to said hydraulic actuator at a second end, the method comprising:

forming an extension to said link plates as a lever arm pivoted to said dipper boom, pivoting said lever arm away from said bucket and toward said dipper boom when said bucket is pivoted toward said lever arm said bucket pivoting at a higher angular rate of travel than said lever arm thereby resulting in said bucket approaching said lever arm and clamping an object between said bucket and said lever arm.

* * * * *